US006591731B2

(12) United States Patent
Goldstein

(10) Patent No.: US 6,591,731 B2
(45) **Date of Patent: *Jul. 15, 2003**

(54) METHOD AND APPARATUS FOR PENETRATING HARD MATERIALS USING A ENERGETIC SLURRY

(75) Inventor: Yeshayahu S. Goldstein, Gaithersburg, MD (US)

(73) Assignee: Apti, Inc., Washington, DC (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/131,758

(22) Filed: Apr. 24, 2002

(65) Prior Publication Data

US 2002/0112600 A1 Aug. 22, 2002

Related U.S. Application Data

(63) Continuation of application No. 09/376,137, filed on Aug. 17, 1999, now Pat. No. 6,405,628.

(51) Int. Cl.[7] ..... E21B 7/00

(52) U.S. Cl. ..... 89/1.15; 86/20.15; 102/440; 102/489; 102/314; 175/4.5

(58) Field of Search ..... 86/20.15, 50; 89/1.15; 175/2, 4.5, 4.57; 102/365, 393, 438, 439, 440, 473, 489, 522, 313, 314, 315, 320

(56) References Cited

U.S. PATENT DOCUMENTS

| | | | | |
|---|---|---|---|---|
| 3,188,955 A | | 6/1965 | Brown | 102/307 |
| 3,437,039 A | | 4/1969 | Hawthorne | 102/438 |
| 3,502,161 A | | 3/1970 | Coman | 175/4.57 |
| 3,511,538 A | | 5/1970 | Guenter | 299/3 |
| 3,762,326 A | | 10/1973 | Edgell et al. | 175/4.6 |
| 3,855,931 A | | 12/1974 | Dardick | 102/438 |
| 3,877,373 A | * | 4/1975 | Bergmann et al. | 102/312 |
| 4,294,171 A | | 10/1981 | Ducharme | 102/317 |
| 4,318,343 A | | 3/1982 | King | 102/365 |
| 4,419,936 A | | 12/1983 | Coates et al. | 102/364 |
| 4,909,152 A | | 3/1990 | Reuter | 102/439 |
| 6,405,628 B1 | * | 6/2002 | Goldstein | 89/1.15 |

FOREIGN PATENT DOCUMENTS

| | | | |
|---|---|---|---|
| DE | 26 22 156 | 11/1977 | 102/440 |
| FR | 488236 | 9/1918 | 102/489 |

* cited by examiner

*Primary Examiner*—Harold J. Tudor
(74) *Attorney, Agent, or Firm*—Rossi & Associates

(57) ABSTRACT

A method and apparatus for drilling and penetrating hard materials utilizes a high velocity gun system that fires multiple shots of a projectile and an energetic slurry at the surface of the material to be penetrated. The penetrating device includes one or more firing barrels that are loaded with a propellant, a projectile and an energetic (explosive) slurry, and are controlled to fire in a preselected firing sequence. The projectile enters the material to be penetrated generating a hole into which the energetic slurry is also fired. The energetic slurry detonates upon contact with the material causing an explosion that further fractures the material and which blows the material out of the hole. The process is repeated until a desired penetration depth is obtained.

14 Claims, 8 Drawing Sheets

METHOD AND APPARATUS FOR PENETRATING HARD MATERIALS USING A ENERGETIC SLURRY

This is a Continuation of application Ser. No. 09/376,137 filed Aug. 17, 1999 now U.S. Pat. No. 6,405,628.

FIELD OF THE INVENTION

The present invention is directed in general to a method and apparatus for drilling or penetrating hard surfaces and materials such as rock, concrete and steel. In particular, the present invention is directed to penetrating hard surfaces and materials utilizing a high velocity gun system that fires multiple shots of a projectile and an energetic slurry at the surface of the material to be penetrated.

BACKGROUND OF THE INVENTION

Conventional excavation techniques employ the use of drills to drill holes in a layer of a material to be penetrated. Explosives are placed in the holes and detonated to cause a layer of the material to fracture and break apart. The resulting rubble is cleared from the excavation site and the process is repeated for a subsequent layer of material to be penetrated. Such conventional excavation techniques result in a slow and tedious process in which several distinct and separate steps must be performed in sequence to excavate each layer of material to be removed.

Convention drilling or boring techniques employ the use of complicated mechanical drilling apparatus. The drilling apparatus incorporates the use of a drill bit to cut through the material being bored. Mechanical drill bits are subject to wear and breakage, however, and therefore must be periodically maintained or replaced. The required maintenance of mechanical drilling apparatus generally increases in proportion to the hardness of the material to be drilled, causing delays and interruptions in the drilling process in order to service the drilling equipment.

In view of the above, it would be desirable to provide a method and apparatus for boring through and excavating hard materials such as rock, concrete and steel that would allow for the rapid removal of material without requiring the separate steps of drilling, placement of explosives, detonation of explosives and debris removal associated with conventional excavation techniques or the use of maintenance prone and mechanically complicated drilling systems associated with conventional drilling or boring techniques.

SUMMARY OF THE INVENTION

The invention provides a method and apparatus for drilling and penetrating hard materials utilizing a high velocity gun system that fires multiple shots of a projectile and an energetic slurry at the surface of the material to be penetrated. More specifically a penetrating device is provided that includes one or more firing barrels. The firing barrels are loaded with a propellant, a projectile and an energetic (explosive) slurry, and are controlled to fire in a preselected firing sequence. The projectile enters the material to be penetrated generating a hole into which the energetic slurry is also fired. The energetic slurry detonates upon contact with the material causing an explosion that further fractures the material and which blows the material out of the hole. The process is repeated until a desired penetration is obtained.

In preferred embodiments, the projectile includes aluminum which reacts with the slurry to further enhance the explosive force, the slurry preferably includes at least one of HMX, RDX and TNT, and the propellant is a preferably a liquid propellent of a type used in conventional liquid propellant guns although conventional solid propellents may be employed. Still further, the device is preferably provided with an explosive payload that is detonated when the desired penetration depth is reached. In a still further embodiment, the device is fitted with control fins and a guidance system for use as an air launched munitions.

Additional features and advantages of the invention will become apparent to those of ordinary skill in the art after review of the following detailed description of the preferred embodiments of the invention with reference to the accompanying drawings.

BRIEF DESCRIPTION OF THE DRAWINGS

The invention will be described with reference to certain preferred embodiments thereof as shown in the accompanying drawings, wherein.

DETAILED DESCRIPTION OF THE PREFERRED EMBODIMENTS OF THE INVENTION

Figure 1:
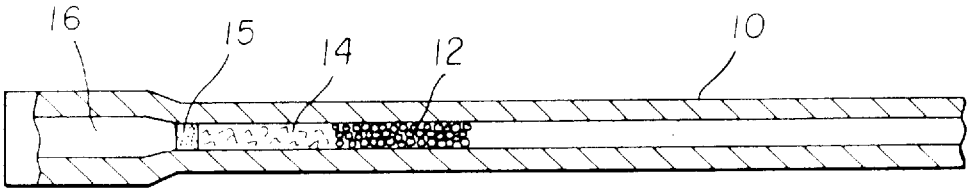
FIG. 1 illustrates a basic penetrating device in accordance with the invention that utilizes a single firing barrel.
Figure 2:
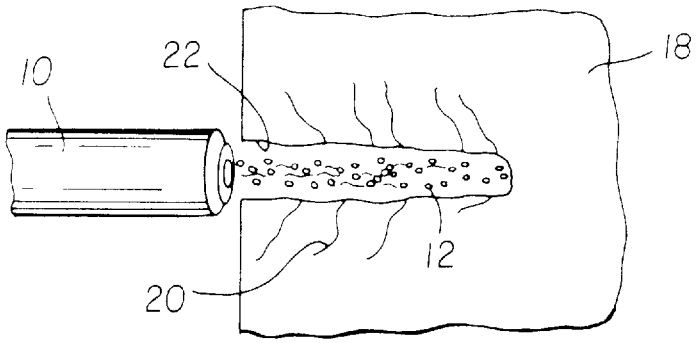
FIG. 2 illustrates the penetration of a material by a projectile fired by the penetrating device illustrated in FIG. 1.
Figure 3:
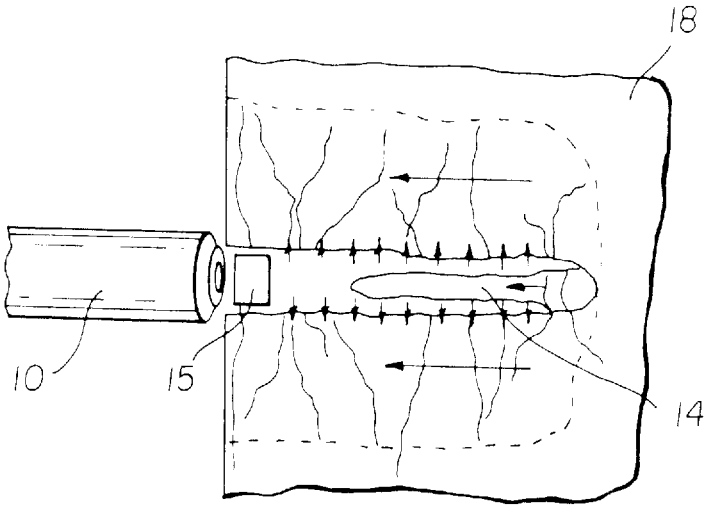
FIG. 3 illustrates the detonation of an energetic slurry fired into a material by the penetrating device illustrated in FIG. 1.
Figure 4:
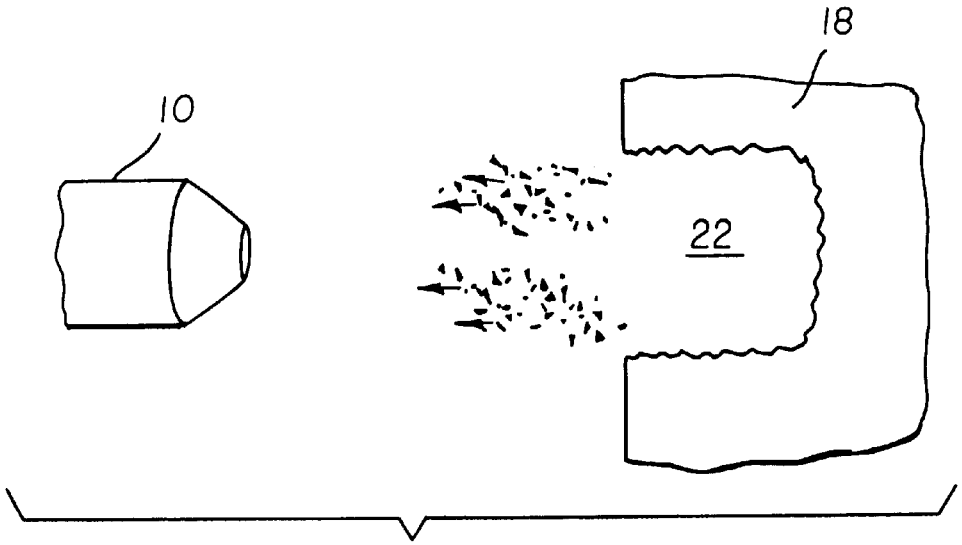
FIG. 4 illustrates the dislodgement of material caused by the detonation of the energetic slurry as illustrated in FIG. 3.

FIG. 1 illustrates a basic penetrating device in accordance with the present invention that includes a firing barrel 10 through which a high velocity jet including a projectile 12 and a fixed volume of energetic slurry 14 is fired by combusting a propellant 16. As shown in FIG. 2, the projectile 12 penetrates the surface of a material 18 to be excavated, thereby causing fractures 20 in the material that expand outward from a penetration hole 22. The energetic slurry 14 follows the projectile 12 into the penetration hole 22 and achieves a fully coupled explosion within the penetration hole 22 (illustrated in FIG. 3), which generates high pressure shock waves and hot gases that cause the fractured material (illustrated by the dashed line) to be blasted outward past the firing barrel 10 of the penetrating device. The penetration hole 22 is thereby cleared of debris during the penetration process as illustrated in FIG. 4. Accordingly, the penetration process is made essentially continuous by firing the penetration device multiple times in rapid succession, with penetration and removal of material taking place without interruption, as successive shot causes the penetration hole 22 to be expanded.

The expendables utilized in the penetrating device include the energetic slurry 14, the projectiles 12, the propellant 16 and an obturator 15 located between the energetic slurry 14 and the propellant 16. The energetic slurry 14 preferably includes an explosive material such as HMX, RDX or TNT, that is separated from the propellant 16 by the obturator 15, which may be made of a plastic or any other suitable material. The projectiles 12 can be made of any desired material including metal or ceramics, depending upon the application and type of material to be penetrated. In a preferred embodiment, the projectiles 12 include at least some portion of aluminum which reacts with energetic slurry 14 to create a more powerful explosion. The projectile 12 can either be a single solid projectile, a projectile that splits into multiple pieces upon firing or multiple projectile elements such as steel shot. The propellant 16 is preferably a conventional liquid propellant utilized in conventional liquid propellant guns, thereby allowing the penetrating device to be easily recharged by pumping the projectiles 12, the slurry 14 and the propellant 16 from pressurized tanks into the firing barrel 10. The propellant 16 is ignited by conventional firing techniques utilized in various types of guns including electric ignition. Alternatively, solid propellant, for example conventional gun powder, can be utilized and the slurry 14 and projectiles 12 can be incorporated within a cartridge type device that essentially disintegrates upon ignition, in which case conventional mechanical type ammunition feeding systems can be utilized.

Figure 5:
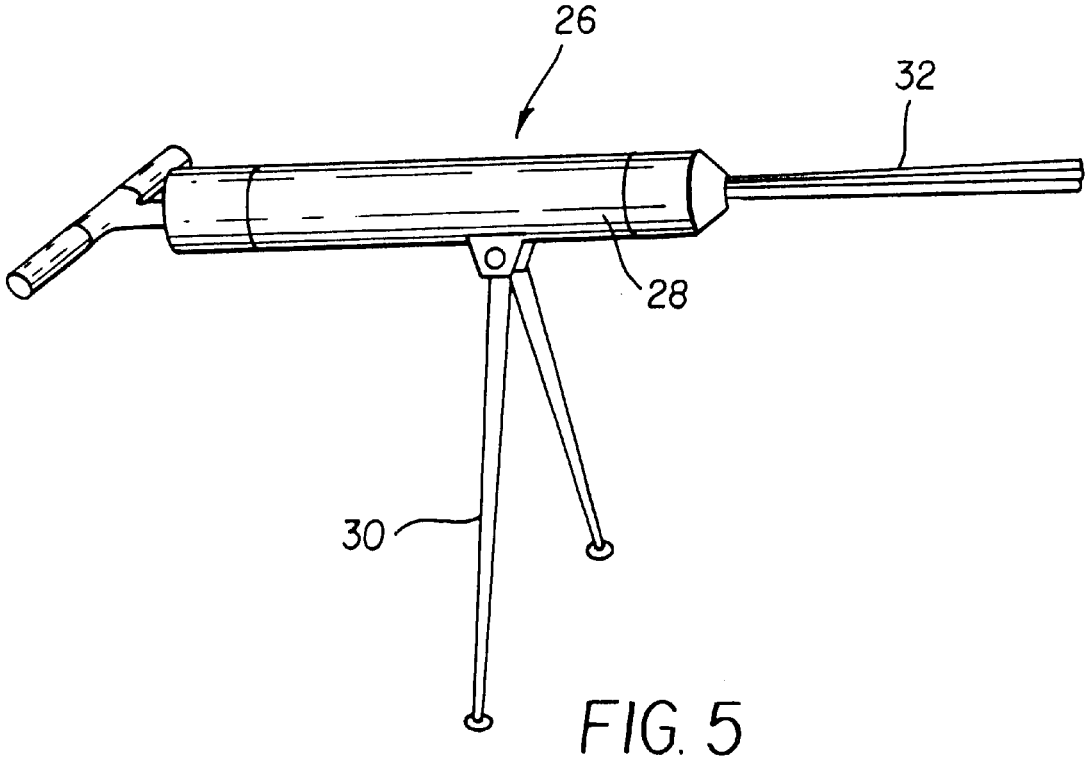
FIG. 5 illustrates a man portable penetrating device in accordance with the present invention that includes three firing barrels.

The penetration device can be easily made portable for use in demolition of walls or similar small structures. Referring to FIG. 5, a penetration device 26 in accordance with the invention is shown including a main body 28 mounted on a collapsible bipod 30. The main body 28 incorporates three gun barrels 32 that fire a combination of energetic slurry and projectiles as described above in rapid succession. Alternatively, the penetration device can be mounted on a vehicle for further ease of mobility.

Figure 6:
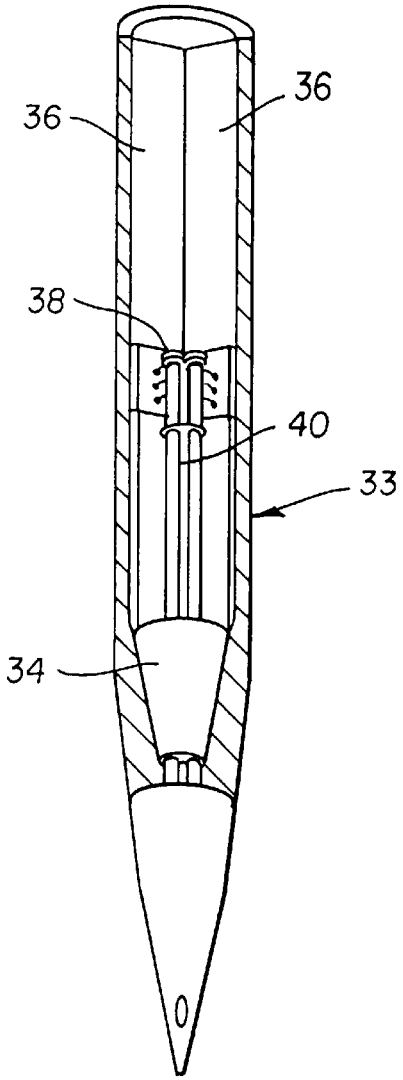
FIG. 6 illustrates a drilling or boring penetrating device in accordance with the present invention that includes multiple firing barrels.

In a further embodiment illustrated in FIG. 6, the invention provides a penetration device 33 for boring deep into a material through the application of successive firings. The deep penetration device includes a fire control unit 34, flexible containers 36 for storage of expendables including propellant, explosive slurry and projectiles, and a check valve system 38 for loading the expendables from the flexible containers into multiple firing barrels 40. The fire control unit 34 controls the operation of the check valve system 38 to load and fire the multiple firing barrels 40 in a prescribed firing pattern, and may be implemented utilizing special purpose control processors, general purpose processors specifically programmed for the application, discrete circuit components or combinations thereof.

Figure 7:
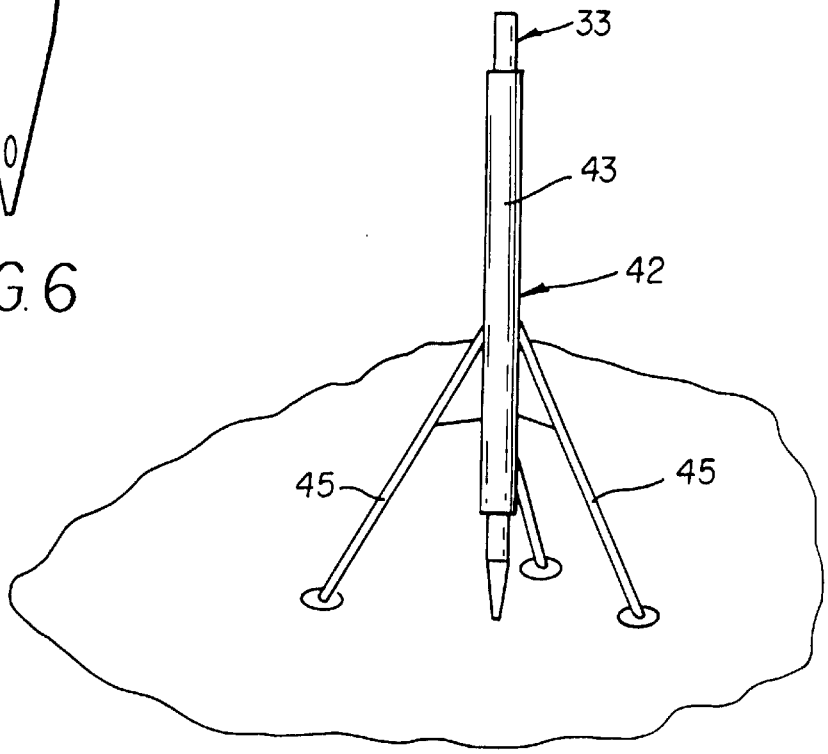
FIG. 7 illustrates a stand for holding the drilling device illustrated in FIG. 6 in a substantially perpendicular position on a material to be bored.
Figure 8:
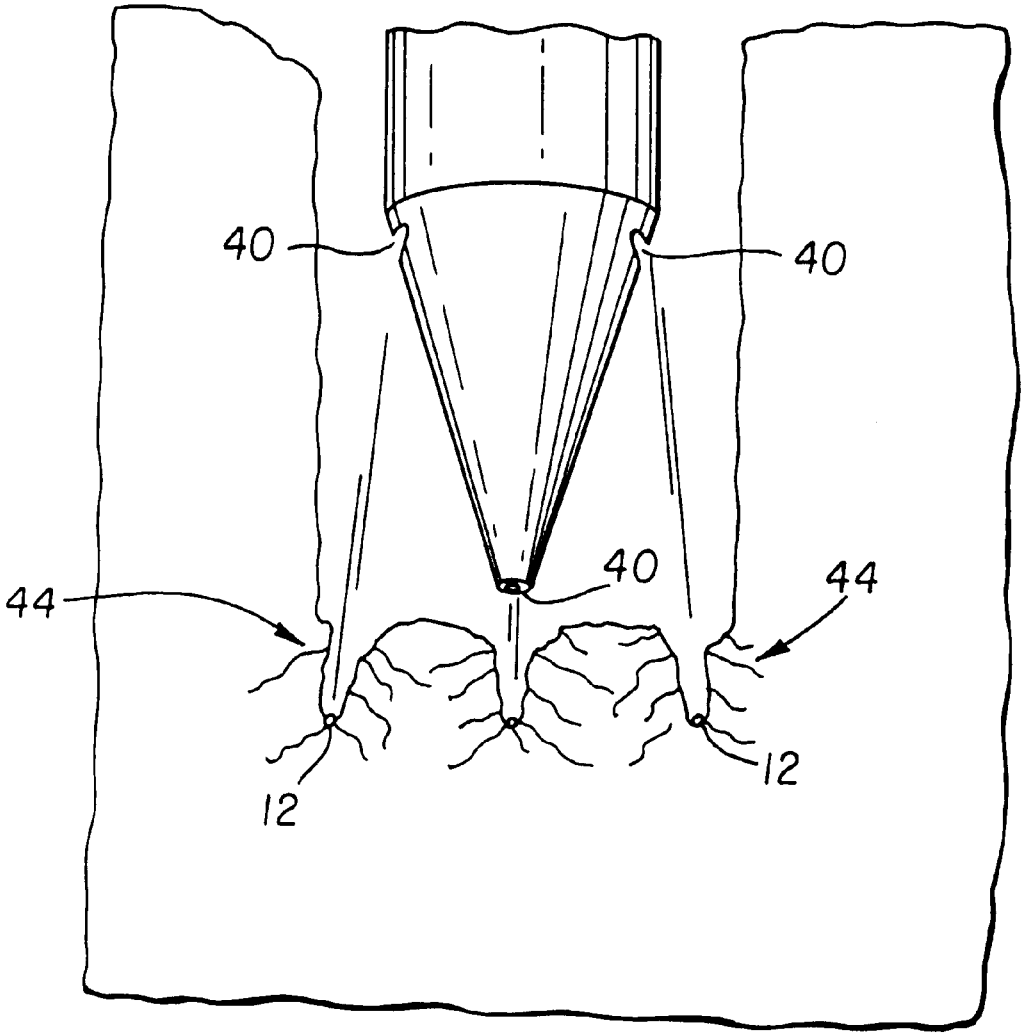
FIG. 8 illustrates the generation of a bore hole by the firing of multiple projectiles by the device illustrated in FIG. 6.
Figure 9:
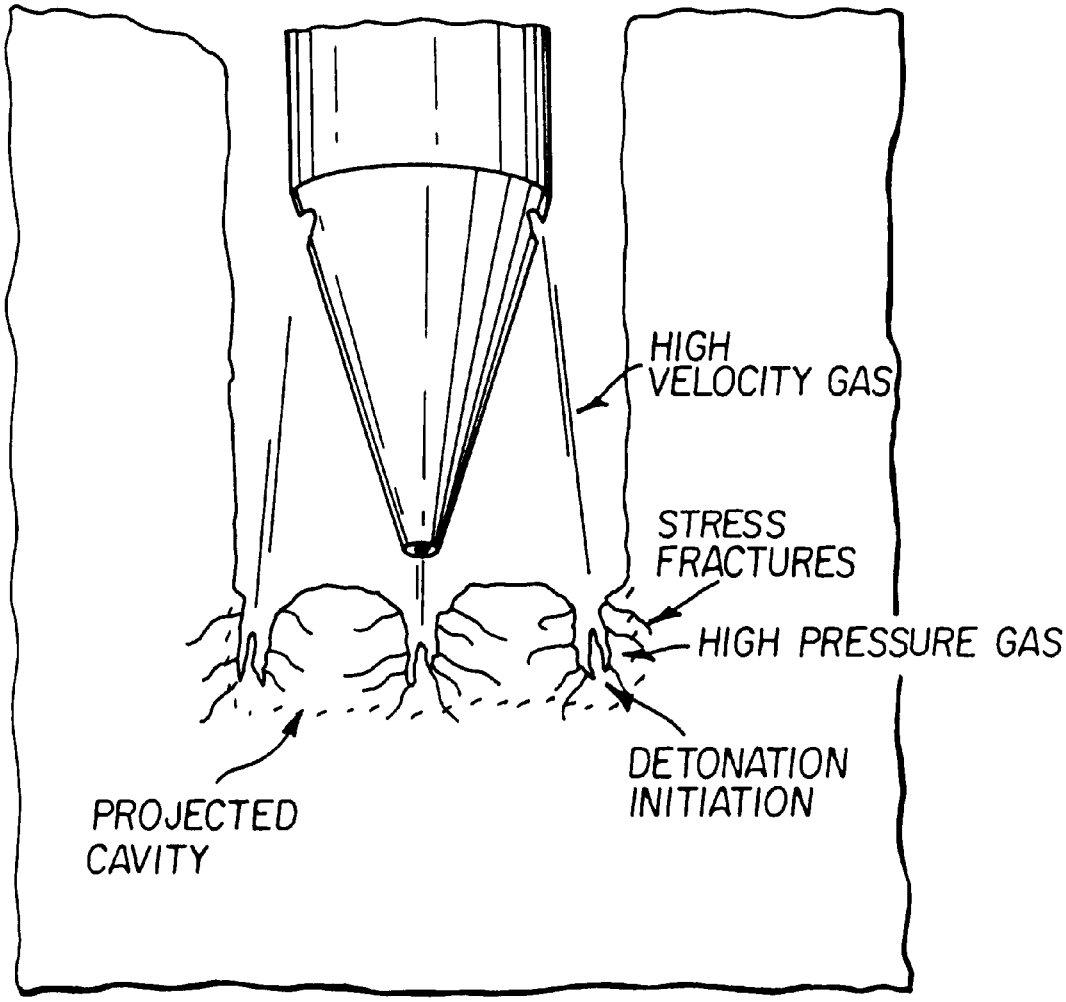
FIG. 9 illustrates the detonation of energetic slurry fired into a bore hole by the device illustrated in FIG. 6.

As is illustrated in FIG. 7, the penetration device 33 is loaded into a firing stand 42 such that the penetration device 33 is substantially perpendicular to a surface of the material to be bored. The firing stand includes a holding tube 43, in which the penetration device 33 is placed, and a number of support legs 45. Upon activation, the fire control unit 34 controls the firing barrels 40 to fire projectiles and energetic slurry into the surface of the material. As illustrated in FIG. 8, the projectiles 12 fired from the gun barrels 40 penetrate the material drilling holes approximately three times their diameter and causing stress fractures 44 in the material. The energetic slurry 14 ignites upon hitting the bottom of the hole being bored, thereby generating high pressure gases that penetrate the stress fractures 44 (as shown in FIG. 9) and causing the fractured material to be blown past the firing barrels 40. The weight of the penetrating device causes it to slide through the holding tube 43 and into the penetration hole formed by the excavation. The process is repeated causing the penetrating device 33 to progressively move deeper into the material to be bored, until a desired penetration depth is reached.

Figure 10:
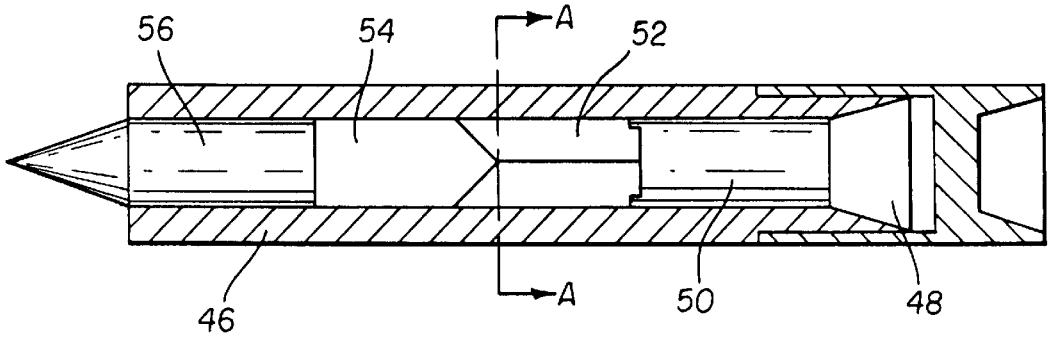
FIG. 10 is a longitudinal cross-sectional view of a preferred embodiment of a projectile to be used in the device illustrated in FIG. 6.
Figure 11:
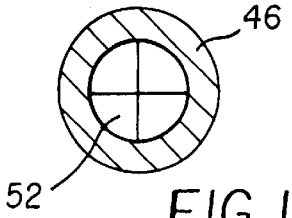
FIG. 11 is a cross-sectional view of the projectile illustrated in FIG. 10 taken along indicated line a—a.
Figure 12:
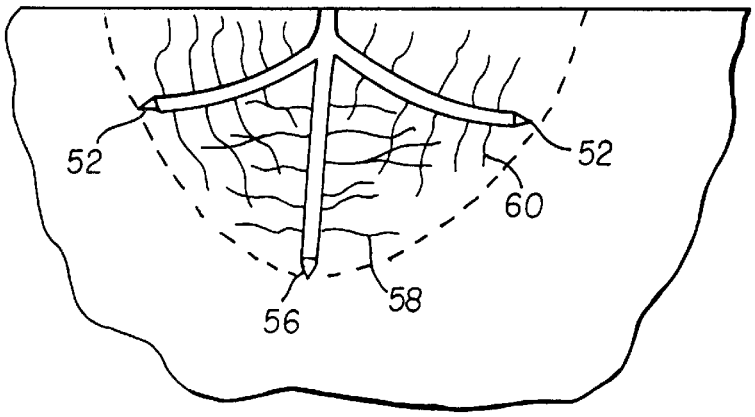
FIG. 12 illustrates the creation of substantially stress fractures by the projectile illustrated in FIG. 11.

In order to maximize the efficiency of the penetrating device, it is desirable to utilize a projectile 12 that will both penetrate perpendicularly to a surface of the material to be penetrated, and will also cause stress fractures that run substantially parallel to surface of the material, so that the material can be easily blasted from the penetration hole by the gases and shock waves generated by the detonation of the energetic slurry 14. FIGS. 10 and 11 illustrate a preferred projectile that includes a Lexan™ sabot 46, an aluminum pusher 48, a steel ram 50, four steel supplemental projectile elements 52, a polyethylene buffer 54 and a steel nose primary projectile element 56. Upon firing, the steel nose primary projectile element 56 penetrates substantially perpendicular to the surface of the material to be bored and generates radiating type stress fractures 58. The supplemental projectile elements 52 separate and open like flower pedals to penetrate the material at oblique angles as illustrated in FIG. 12, causing their own stress fractures 60 that overlap the stress fractures 58 generated by the primary projectile element 56. The cross-fracturing substantially weakens the material over single dimensional fractioning that would occur if all projectiles penetrated perpendicular to the surface. Accordingly, the detonation of the energetic slurry 14 causes a larger volume of the material to be removed (indicated by dashed line) as opposed to the results obtained from a single perpendicularly entering projectile. a crater into which the device can penetrate.

Figure 13:
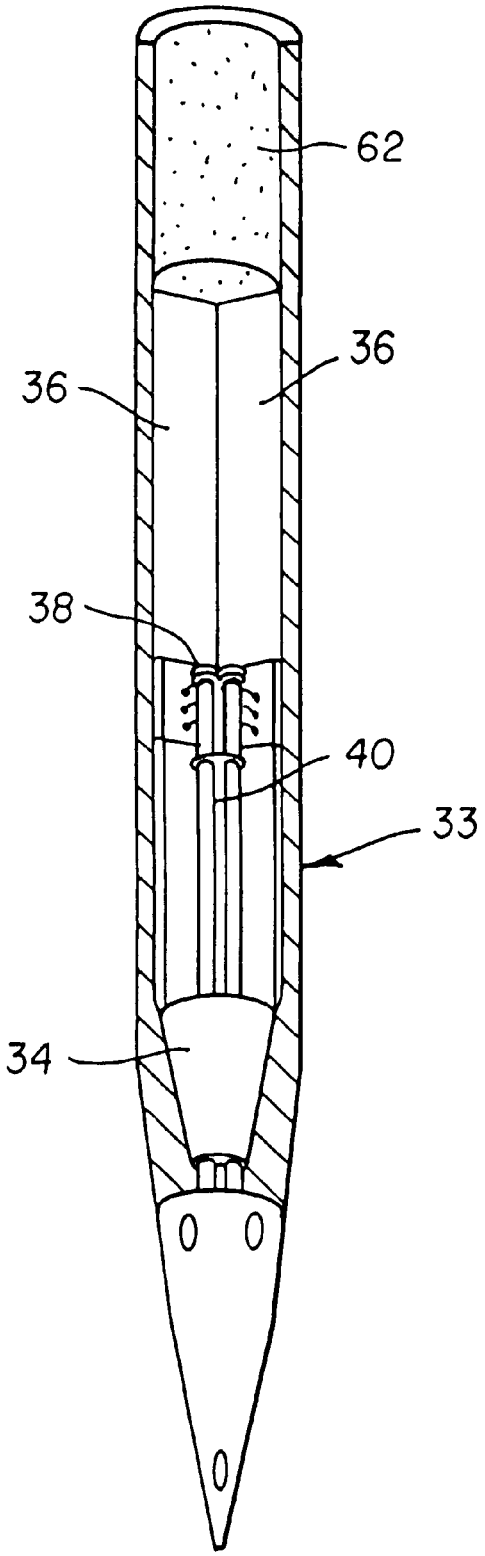
FIG. 13 illustrates a penetrating device of the type illustrated in FIG. 6 further including an explosive payload.
Figure 14:
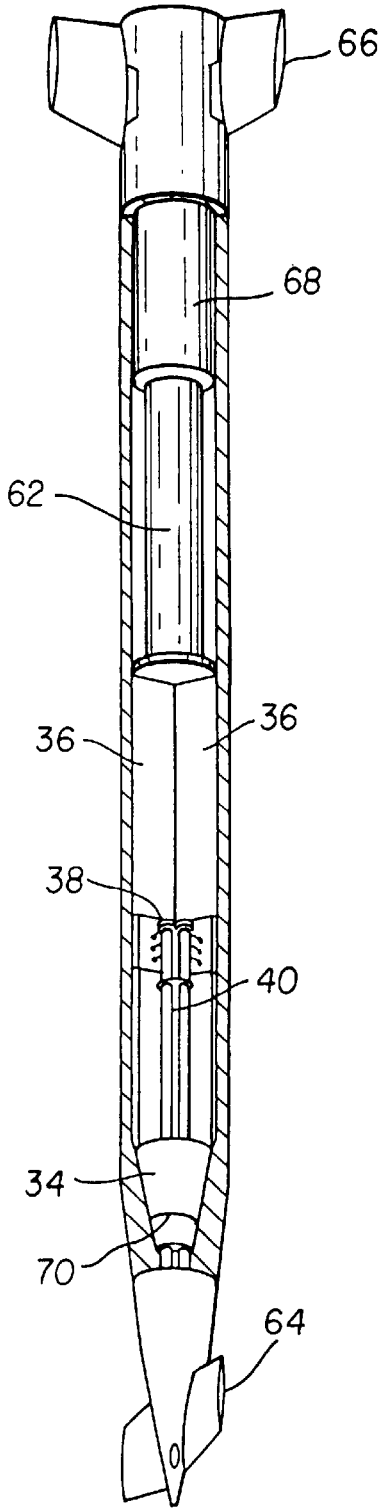
FIG. 14 illustrates a penetrating device of the type illustrated in FIG. 13 configured as an air launched munition.

The invention can be utilized for any number of applications. In one preferred embodiment, the penetrating device is further fitted with an explosive payload 62, as shown in FIG. 13, that is detonated once the penetrating device has reached a specified depth. Still further, the penetrating device illustrated in FIG. 13 can be further modified by the addition of control canards 64, control fins 66 and a guidance system 68 into an air launched penetrating munitions, as illustrated in FIG. 14. In this embodiment, the penetrating device is also provided with a stabilizing drag chute (not shown) to stabilize the device so that it hits the ground in a substantially vertical orientation. Prior to impact, a ground proximity sensor 70 is utilized to signal the control unit 34 to begin firing the firing barrels 40 just prior to impact, thereby creating a crater into which the device can penetrate.

The invention provides a number of advantages over conventional excavation and drilling techniques. For example, large amounts of material can be rapidly removed at relatively low cost. The device does not require complex mechanical support systems that are subject to failure or extensive maintenance. Further, the device can be remotely operated or preprogrammed for remote operation thereby avoiding potential injuries.

Figure 15:
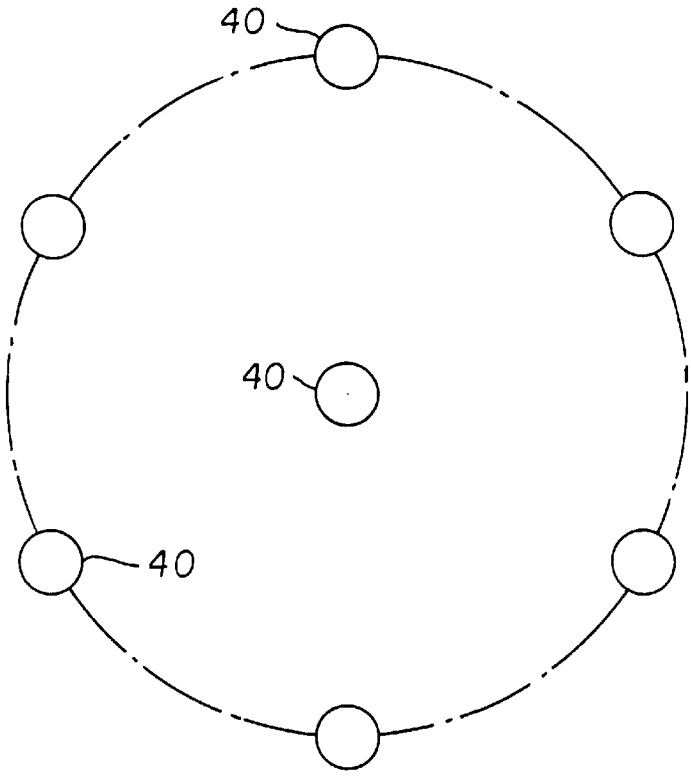
FIG. 15 illustrates a preferred number and pattern of firing barrels for a penetrating devices of the type illustrated in FIGS. 6, 13 and 14.

The invention has been described with reference to certain preferred embodiments thereof. It will be understood, however, that modifications and variations are possible within the scope of the appended claims. For example, the type of propellent, energetic slurry and projectile to be used will necessary be dependent on the application and material to be penetrated. The number and configuration of the firing barrels may also be varied. In general, the number and horizontal separation of the firing barrels determine the horizontal separation in the fractures formed in them material to be penetrated, while the projectile structure determines the depth. FIG. 15, for example, illustrates one preferred distribution of firing barrels, wherein six firing barrels are disposed at substantially equal intervals in a circle and a seventh barrel is provided at the center of the circle.

What is claimed is:

1. An apparatus comprising:

at least one firing barrel;

a projectile comprised of multiple projectile elements loaded in the firing barrel;

an energetic slurry loaded rearward of the projectile in the firing barrel; and firing means for firing together the projectile and the energetic slurry from the firing barrel.

2. An apparatus as claimed in claim 1, wherein the firing means includes a liquid propellant.

3. An apparatus as claimed in claim 1, wherein the energetic slurry includes at least one of HMX, RDX and TNT.

4. An apparatus as claimed in claim 1, wherein the projectile includes aluminum.

5. An apparatus comprising:

a plurality of firing barrels;

supply means for supplying a projectile comprised of multiple projectile elements, an energetic slurry rearward of said projectile, and a propellant into each of said firing barrels; and control means for controlling the firing of the projectile and the energetic slurry from each of said firing barrels.

6. An apparatus as claimed in claim 5, further comprising an explosive payload.

7. An apparatus as claimed in claim 6, further comprising control fins and a guidance system.

8. An apparatus as claimed in claim 5, wherein said propellant comprises a liquid propellant.

9. An apparatus as claimed in claim 5, wherein the energetic slurry includes at least one of HMX, RDX and TNT.

10. An apparatus as claimed in claim 5, wherein the projectile includes aluminum.

11. A method of penetrating a material comprising the steps of:

a. loading a projectile comprised of multiple projectile elements, an energetic slurry rearward of said projectile, and a propellent into a firing barrel;

b. firing the projectile and the energetic slurry at the material to be penetrated; and c. repeating steps a and b until a desired penetration is obtained.

12. A method as claimed in claim 11, wherein said propellant comprises a liquid propellant.

13. A method as claimed in claim 11, wherein the energetic slurry includes at least one of HMX, RDX and TNT.

14. A method as claimed in claim 11, wherein the projectile includes aluminum.

* * * * *